US005725027A

United States Patent [19]

Cox

[11] Patent Number: 5,725,027

[45] Date of Patent: Mar. 10, 1998

[54] WEFT FEEDER

[75] Inventor: Gerard Cox, Geldrop, Netherlands

[73] Assignee: TE Strake B.V., Deurne, Netherlands

[21] Appl. No.: 737,082

[22] PCT Filed: Apr. 28, 1995

[86] PCT No.: PCT/NL95/00154

§ 371 Date: Oct. 30, 1996

§ 102(e) Date: Oct. 30, 1996

[87] PCT Pub. No.: WO95/30033

PCT Pub. Date: Nov. 9, 1995

[30] Foreign Application Priority Data

May 3, 1994 [NL] Netherlands ..... 9400726

[51] Int. Cl.[6] ..... D03D 47/36; B65H 1/22

[52] U.S. Cl. ..... 139/452; 242/47.13

[58] Field of Search ..... 139/452; 242/47.01, 242/47.12, 47.13

[56] References Cited

U.S. PATENT DOCUMENTS

| | | | |
|---|---|---|---|
| 3,971,522 | 7/1976 | Pfarrwaller | 139/452 |
| 4,632,154 | 12/1986 | Maina | 139/452 |
| 4,747,549 | 5/1988 | Balzarotti | 139/452 |
| 5,133,388 | 7/1992 | Tholander | 139/452 |
| 5,211,207 | 5/1993 | Ichikawa | 139/452 |
| 5,520,226 | 5/1996 | Pedrini | 139/452 |

FOREIGN PATENT DOCUMENTS

| | | | |
|---|---|---|---|
| 0 142 591 | 5/1985 | European Pat. Off. | D03D 47/36 |
| 0 164 033 | 12/1985 | European Pat. Off. | D03D 47/36 |
| 0 469 527 | 2/1992 | European Pat. Off. | D03D 47/36 |
| 9201436 | 3/1994 | Netherlands | D03D 47/36 |

*Primary Examiner*—Andy Falik

*Attorney, Agent, or Firm*—IP Group of Pillsbury Madison & Sutro LLP

[57] ABSTRACT

A pre-unwinding device for use in a spoolless weaving loom, using a weft injector, includes a winding body with a variable adjustable diameter situated within a thread receiving cylinder in which a thread stopping device can be activated. A receiving cylinder and a stopping device are movable in a plane which is almost perpendicular to the axis of the winding body.

7 Claims, 2 Drawing Sheets

WEFT FEEDER

BACKGROUND OF THE INVENTION

The invention is related to a pre-unwinding device for use in a weaving loom, and more in particularly to a spoolless weaving loom using a weft injector.

Weaving looms, in particular those from the latter type, are provided with a pre-unwinding device that unwinds a weftthread from a supply bobbin to produce a texture or weave, and a winding device in particular a hydraulic or pneumatic injector that is positioned in between the supply bobbin and a device, for the introduction of the weftthread in between the warpthreads.

The winding device winds the thread by a relative rotation of the thread with respect to the winding device, in adjacent, whether separated or unseparated, windings. In general the winding device is stationairy and the thread is wound onto it by an rotating arm that is hollow.

The thread is drawn off the winding device by the above-mentioned device, for instance the injector and transferred in between the warpthreads.

After drawing off the required length of the thread, which equals approximately the width of the total system of adjacent warpthreads, the drawing of the thread is stopped and the thread is cut.

To cause the stopping of the thread, in order to determine the length of the weftthread, a stopping device is provided in a receiving cylinder which surrounds the winding device, that is positioned and shaped in such a way that as soon as the thread discharge from the winding device has to stop moving, is activated within the receiving cylinder and the continuation of the transport is impeded.

The stopping device can be a pin, for example that is driven electro-magnetically and moves about perpendicular to the axis of the winding device.

In between the winding device and the surrounding cylinder the thread moves towards the cylinder, and from this point towards the device, for instance the injector, to introduce the weftthread in between the warpthreads.

The surrounding cylinder is usually provided with a dome-shaped extension including a downstream located central discharge opening for the thread.

By suitably dimensioning the winding device and the surrounding receiving cylinder and a correct installation of the stopping device, it is possible to achieve only a slight bending of the discharged thread. This implies a smooth winding of the thread in order to prevent, also for thin and vulnerable threads, needless friction which might result in coil ball-formation, damage to threads and possibly breakage.

Such a correct dimensioning and positioning is almost impossible if the winding device has a variable adjustable diameter and the receiving cylinder does not have a variable diameter.

Such types of devices are known and, e.g., described in EP-A-9 111 274 5.4.

At a smaller diameter setting of the winding body and an unchanged diameter of the receiving cylinder the annular clearance in between these parts is increased, and therefore the thread might undergo a larger "bend".

This problem could be solved by decreasing the diameter of the receiving cylinder. This implies practically the usage of different receiving cylinders with different diameters or a receiving cylinder with variable diameter. Both solutions are either too cumbersome and/or too complex and therefore expensive.

SUMMARY OF THE INVENTION

An object of the invention is to solve these disadvantages and obtain further advantages.

A pre-unwinding device according to the invention for use in a spoolless weaving loom, in particular using a weft injector, comprising a central shaft enclosed by a housing, whereby the thread is taken from a supply coil, and by a relative rotation of the central shaft and a winding body, is wound on that body in adjacent eventually separated strands, whereby the winding body has a adjustable diameter in a plane perpendicular to the central shaft and is situated within a surrounding receiving cylinder for thread leaving the winding body, provided with a stopping device having such a shape and position that at the moment that the thread discharge from the winding body has to be ended, the stopping device can be activated within the receiving cylinder, is characterized in that the receiving cylinder and the stopping device are moveable in a plane almost perpendicular to the central axis of the winding body.

The movement of the receiving cylinder and the stopping device in the apparatus according to the invention is adapted to the change of the diameter of winding body and preferrably in such a way that at all settings of the diameter of the winding body the clearance in between the winding body and the receiving cylinder at the location of the stopping device is equal. Therefore, the "bend" of the thread will always be almost the same. Because the stopping device is moved as well, the stopping device can be activated always in a space of the same dimensions.

An effective embodiment of the invention is obtained in when the receiving cylinder and the stopping device are connected together. For all changes in the diameter of the winding body and a related adapted displacement of the receiving cylinder, an constant situation on the spot of the stopping device is automatically guaranteed.

The change of the diameter of the winding body and the related motion of the receiving cylinder wil be effected manually in general in a stationairy apparatus. It is possible by means of a suitable construction to couple both changes.

In a preferred embodiment of the device according to the invention, a disc-or ring-shaped device is located downstream with respect to the winding body within the receiving cylinder, almost perpendicular to the central axis of the winding body, with a diameter smaller than the diameter of the receiving cylinder and at least equalling the largest adjustable diameter of the winding body.

This disc or ring-shaped body is intended to improve the course of the thread after the drawing off from the winding body. The thread is guided by the edge of the disc.

The disc or ring-shaped body can have a fixed position with respect to the winding body, but preferrably it is moved sideways together with the receiving cylinder and the stopping device. In this way the situation at the spot of the stopping device is the same for each alteration of the diameter of the winding body, making one disc or ring sufficient, which would be impossible when the disc has an fixed position with respect to the winding body.

If a disc or ring-shaped body is used, as described above, the stopping device is positioned in such way that it is activated in between the clearance of receiving cylinder and the disc or ring, and closes this space locally. If the stopping device is pin-shaped it can be activated in a space in the edge of the disc or ring.

U.S. Pat. No. 5,133,388 describes a disc with an upstanding edge guiding the thread that leaves the winding body in a small slit in between the upstanding edge and the interior of the receiving cylinder. The stopping device can be located here.

BRIEF DESCRIPTION OF THE DRAWINGS

The invention is described below with reference to the attached drawings, in which.

DETAILED DESCRIPTION

Figure 1:
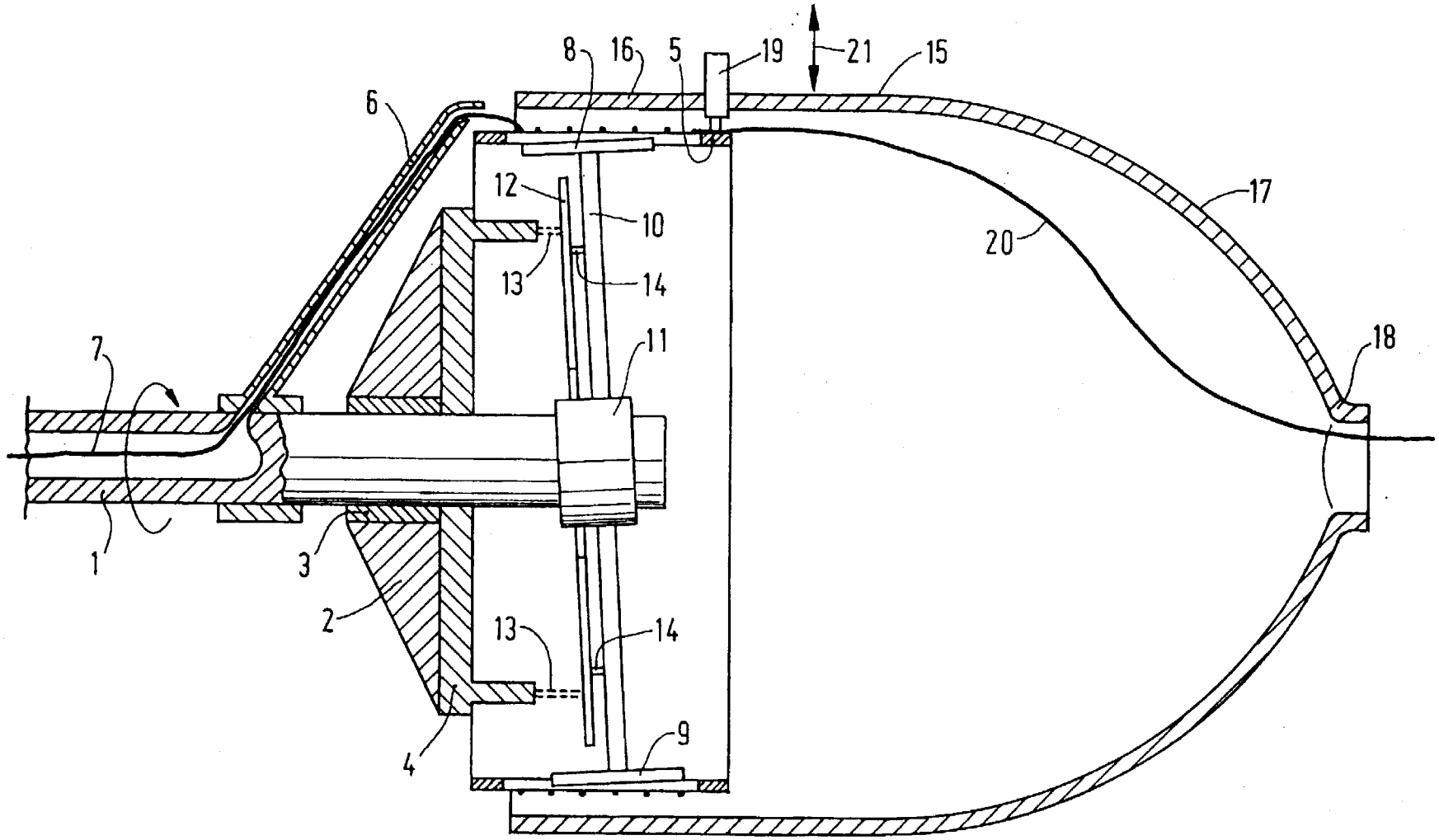
FIG. 1 is a longitudinal sectional view of a first embodiment of a pre-unwinding device of the present invention.

In FIG. 1 [1] is a central axis that is supported in a housing [2] by means of bearing [3]. This axis rotates in the direction of the arrow. Fixed to the housing [2] is a base-plate [4] supporting the stationairy winding body [5]. By a supplying device [6] for the thread that is connected to the axis [1], the thread [7] is wound on the winding body [5]. The fingers [8] and [9] are provided to move the windings in the direction of the axis. These fingers protrude through openings in the winding body [5]. These fingers are connected to a driver [10] provided with a bearing [11] that is positioned eccentrically, in a known manner, with respect to the central axis of the driving axis thereby forming a small angle. By this way of bearing, the fingers [8] and [9] are following an elliptical pattern having a component parallel to the central axis and a component radial to the axis. Such a construction of the driver is described, eg, in U.S. Pat. No. 4,632,154 and Japanese patent 43 377/91. In the latter patent the winding body is constructed from a cylinder surface and its axis coincides with the driving axis, and is divided into sector-shaped elements. These sector-shaped elements are adjustable radially whereby the diameter of the surrounding plane of these elements is increased or decreased. Different constructions for adjustment of the diameter of the winding body are possible.

In FIG. 1 [15] is a body of revolution with an almost cylindrical part [16] adjacent to the winding body [5] and an adjacent balloon-shaped part [17] provided with an discharge device for the thread [18]. [19] is a stopping body that blocks the thread (20) that is being drawn off the winding body, at the right moment.

It is obvious that at different diameters of the winding body [5], realized, eg, by the construction of Japanese patent 43 377/91, the clearance in between the body and the part [16] is variable.

At the spot of stopping device [19] this can be seriously disadvangeous because, as is stated above, the thread that is drawn off the winding body [5] receives a to large "bend" easily, resulting in the above-mentioned disadvantages.

This problem is solved according to the invention by moving the receiving cylinder [16] and the stopping body in a direction almost perpendicular to the axis of the winding body [5], as indicated by the arrow [21]. In this way the clearance in between the body [5] and the part [16] at the site of the stopping device can be kept constant. On the other hand the clearance in between the body [5] and the receiving cylinder [16] opposite the stopping body can increase or decrease, but this is no problem because no stopping body is present at that spot.

Although it is possible to move stopping body [19] and receiving cylinder [16] independently it is preferred with respect to the simplicity of the construction and its adjustment, to connect the stopping body [19] and the receiving cylinder [16] with each other.

In FIG. 1 [13] and [14] indicate a positioning device, as described by the Dutch patent application 920 1436 (published 1st Mar. 1994). This part is not essential for the present invention.

Figure 2:
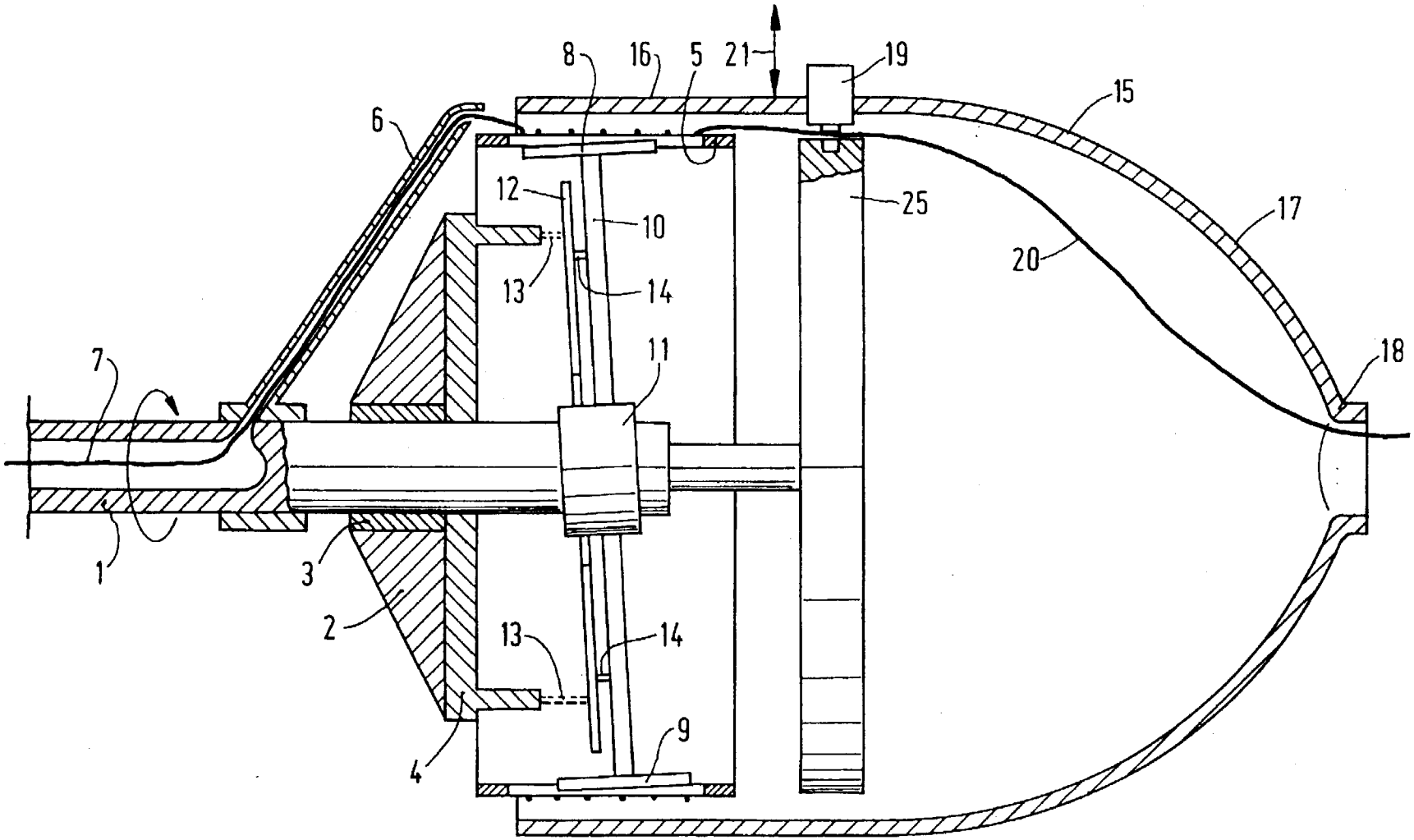
FIG. 2 is a longitudinal sectional view of a second, improved embodiment thereof.

In FIG. 2 [25] is a discshaped device that is positioned almost perpendicular to the axis of the winding body and is connected thereto. The stopping body [19] is activated in the space in between the receiving cylinder or the balloon-shaped extension [17] and the disc [25]. This results in a more fluent course of the thread [20].

Disc [25] can be connected to winding cylinder [16] and stopping device [19].

FIG. 2 indicates the parts in the same manner, using the same numbers corresponding to the related parts of FIG. 1.

The stopping body [19] is preferably pin-shaped and formed and positioned in such way that it corresponds to a clearance in the edge of disc [25] in the stopped position.

Disc [25] is preferably moved together with the receiving cylinder [16] and the stopping body [19].

I claim:

1. A pre-unwinding device for use in a spoolless weaving loom using a weft injector, said device comprising:

a winding body having a central axis;

a central shaft enclosed by a housing, whereby thread can be taken from a supply coil, and said winding body by a relative rotation of the central shaft and, be wound on the winding body in adjacent eventually separated strands, whereby the winding body has an adjustable diameter in a plane perpendicular to the central shaft;

a receiving cylinder;

said winding body being situated within and surrounded by said receiving cylinder;

said receiving cylinder being provided with a stopping device having such shape and position that at the moment that thread discharge from the winding body is ended, the stopping device can be activated within the receiving cylinder;

said receiving cylinder and said stopping device being moveable in a plane which is almost perpendicular to the central axis of the winding body.

2. The pre-unwinding device as claimed in claim 1, wherein:

said stopping device and said receiving cylinder are connected together.

3. The pre-unwinding device as claimed in claim 1, further comprising:

a disc- or ring-shaped device located downstream with respect to said winding body within said receiving cylinder, said disc- or ring-shaped body being almost perpendicular to said central axis of said winding body, and having an external diameter which is smaller than the internal diameter of said receiving cylinder where said disc- or ring-shaped device is located, and which at least equals the largest external diameter possessed in use by said winding body.

4. The pre-unwinding device as claimed in claim 3, wherein:

said disc- or ring-shaped device is arranged to be movable together with said receiving cylinder and said stopping device.

5. The pre-unwinding device as claimed in claim 3, wherein:

said stopping device is arranged to be activated in a space in between said receiving cylinder and said disc- or ring-shaped device, and locally close this space.

6. The pre-unwinding device as claimed in claim 3, wherein:

said stopping device is pinshaped and corresponds in location to a clearance provided in an edge of said disc- or ring-shaped device.

7. A spoolless weaving loom provided with a weft injector and with a pre unwinding device comprising:

a central shaft enclosed by a housing, whereby thread can be taken from a supply coil, and said winding body by a relative rotation of the central shaft and, be wound on the winding body in adjacent eventually separated strands, whereby the winding body has an adjustable diameter in a plane perpendicular to the central shaft;

a receiving cylinder;

said winding body being situated within and surrounded by said receiving cylinder;

said receiving cylinder being provided with a stopping device having such shape and position that at the moment that thread discharge from the winding body is ended, the stopping device can be activated within the receiving cylinder;

said receiving cylinder and said stopping device being moveable in a plane which is almost perpendicular to the central axis of the winding body.

* * * * *